United States Patent [19]

Berry et al.

[11] 4,397,323

[45] Aug. 9, 1983

[54] FRAME

[76] Inventors: James B. Berry, c/o George Spector, 3615 Woolworth Bldg., 233 Broadway; George Spector, c/o James B. Berry, 3615 Woolworth Bldg., 233 Broadway, both of New York, N.Y. 10007

[21] Appl. No.: 410,133

[22] Filed: Aug. 20, 1982

[51] Int. Cl.[3] ..... A45D 24/00

[52] U.S. Cl. ..... 132/11 R; 132/45 R

[58] Field of Search ..... 132/11 R, 45 R, 101

[56] References Cited

U.S. PATENT DOCUMENTS

| | | | |
|---|---|---|---|
| 684,945 | 10/1901 | McCulloch | 132/101 |
| 1,192,085 | 7/1916 | Marchins | 132/45 R |
| 3,180,341 | 4/1965 | Dumont | 132/45 R |
| 4,106,515 | 8/1978 | Miller | 132/45 R |

*Primary Examiner*—Gregory E. McNeill

[57] ABSTRACT

A hair frame is provided that consists of a comb, a frame having front vertical member, a rear vertical member and a horizontal member affixed between the front and rear vertical members. A ratchet wheel has a shaft that passes through a centrally located aperture in the rear vertical member affixing said ratchet wheel to the comb allowing the comb and ratchet wheel to rotate together. A spring loaded pawl having a shaft that mates with another aperture in the rear vertical member allowing the pawl to move and engage with the ratchet wheel so that the comb can be adjusted to and held in any position. Another embodiment incorporates the invention into a sloted head band.

3 Claims, 6 Drawing Figures

FRAME

BACKGROUND OF THE INVENTION

The instant invention relates generally to hair combs and more specifically it relates to a hair frame that is decorative and adjustable.

It is a known fact that when women pin up their hair they can use a multiple of combs placed in different directions into the hair on their heads. This does not look too attractive so accordingly this situation is in need of an improvement.

SUMMARY OF THE INVENTION

A principle object of the present invention is to provide a hair frame that has an ornamental front member that will always be right side up regardless which way the comb is rotated and placed into the hair.

Another object is to provide a hair frame that is adjustable and will hold the comb in any position desired.

An additional object is to provide a hair frame that is adjustable and can be used in conjunction with a head band.

A further object is to provide a hair frame that is economical in cost to manufacture.

A still further object is to provide a hair frame that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENT

Figure 1:
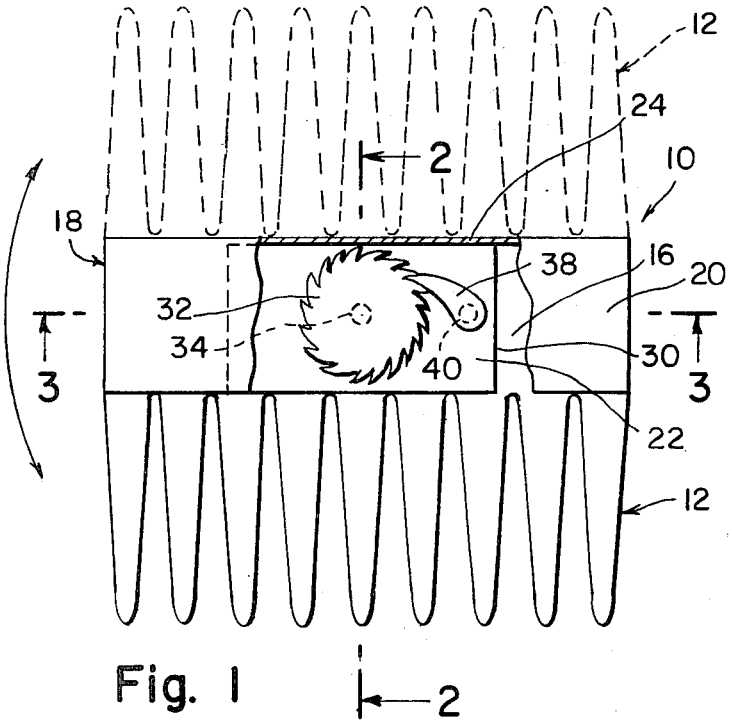
FIG. 1 is a front view with parts broken away of the invention.
Figure 2:
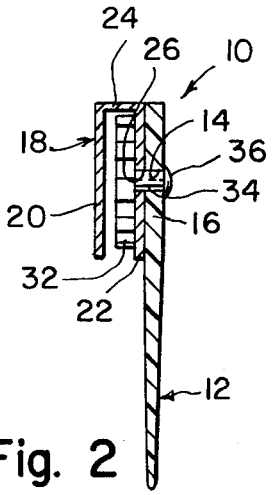
FIG. 2 is a cross-sectional view taken along line 2—2 in FIG. 1.
Figure 3:
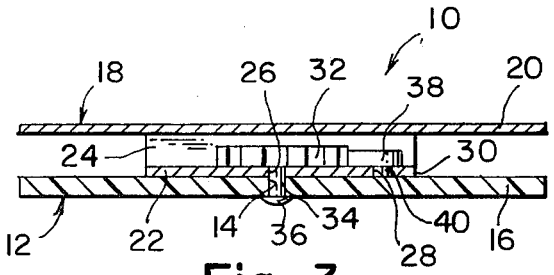
FIG. 3 is a cross-sectional view taken along line 3—3 in FIG. 1.

Turning now descriptively to the drawings, in which similar reference characters denote similar elements throughout the several views, FIGS. 1, 2 and 3, illustrates a hair frame 10. The hair frame 10 consists of a comb 12 having a centrally located aperture 14 in the back portion 16 and a frame 18.

The frame 18 has a front vertical ornamental member 20, a rear vertical member 22 and a horizontal member 24 affixed between the top of the front vertical ornamental member 20 and the top of the rear vertical member 22. The front ornamental member 20 as illustrated in the drawings is wider than rear vertical member 22 and horizontal member 24 but they all can be of the same width if so desired. The rear vertical member 22 has a centrally located aperture 26 and another aperture 28 adjacent to one end 30 thereof.

A ratchet wheel 32 is shown having a shaft 34 that passes through the centrally located aperture 26 in the rear vertical member 22 and the centrally located aperture 14 in the back portion 16 of the comb 12 so that a head 36 can be formed on the free end of the shaft 34 by pressing. This affixes the ratchet wheel 32 to the comb 12 via the shaft 34 allowing the comb 12 and the ratchet wheel 32 to rotate together.

A spring loaded pawl 38 having a shaft 40 mates with the other aperture 28 adjacent to end 30 of the rear vertical member 22 allowing the pawl 38 to move and engage with the ratchet wheel 32 so that the comb 12 can be adjusted to and held in any position (as shown in dotted in FIG. 1). The front vertical ornamental member 20 will cover and hide the ratchet wheel 32 and the pawl 38.

Figure 4:
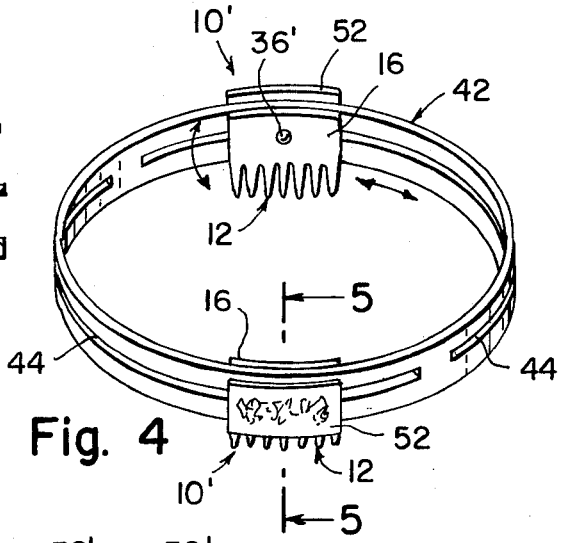
FIG. 4 is an isometric view of another embodiment of the invention.
Figure 5:
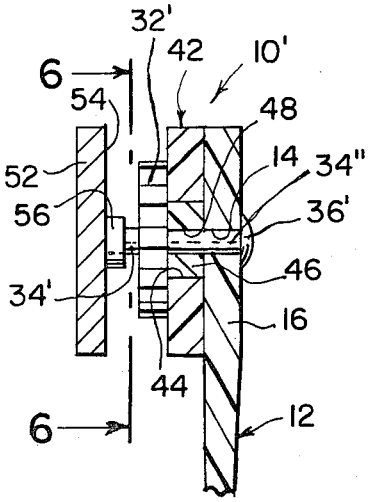
FIG. 5 is an enlarged cross-sectional view taken along line 5–5 in FIG. 4.
Figure 6:
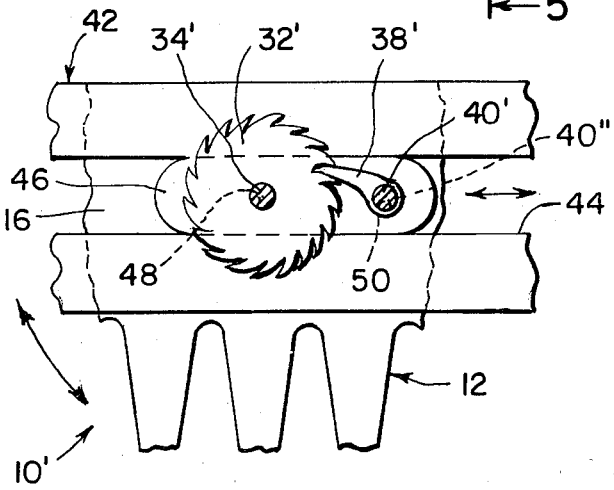
FIG. 6 is a cross sectional view taken along line 6–6 in FIG. 5.

FIGS. 4, 5 and 6 illustrate another embodiment of the invention. A pair of hair frames 10' are shown slidably affixed to a head band 42 having two annular slots 44. Each hair frame 10' consists of a comb 12 having a centrally located aperture 14 in the back portion 16. A slide member 46 is shown best in FIGS. 5 and 6 having two apertures 48 and 50. The slide member 46 slidably fits into the slot 44 in the head band 12.

A ratchet wheel 32' has a forward shaft 34' and a rearward shaft 34''. The rearward shaft 34'' passes through aperture 48 in the slide member 46 and centrally located aperture 14 in the back portion 16 of the comb 12 so that a head 36' can be formed on the free end of the rearward shaft 34' by pressing. This affixes the ratchet wheel 32' to the comb 12 via the rearward shaft 34' allowing the comb 12 and the ratchet wheel 32' to rotate together.

A spring loaded pawl 38' has a forward shaft 40' and a rearward shaft 40''. The rearward shaft 40'' mates with aperture 50 of the slide member 46 allowing the pawl 38' to move and engage with the ratchet wheel 32' so that the comb 12 can slide to, be adjusted to and held in any position.

An ornamental front plate 52 is shown having a pair of shaft supports on the rear surface 54. Only one shaft support 56 is shown in FIG. 5. The shaft support 56 mounts onto the free end of the forward shaft 34' of the ratchet wheel 32'. The other shaft support (not shown) mounts onto the free end of the forward shaft 40' of the pawl 38' allowing both said forward shafts 34' and 40' to turn whereby the ornamental front plate 52 is held in position so that the ornamental front plate 52 will cover and hide the ratchet wheel 32' and the pawl 38'.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hair frame which comprises:

(a) a comb having a centrally located aperture in back portion;

(b) a frame having a centrally located aperture and another aperture adjacent to one end thereof;

(c) a ratchet wheel having a shaft that passes through said centrally located aperture in said frame and centrally located aperture in said back portion of said comb so that a head can be formed on free end of said shaft by pressing, affixing said ratchet wheel to said comb allowing said comb and said ratchet wheel to rotate together; and (d) a spring loaded pawl having a shaft that mates with said other aperture adjacent to one end of said frame, allowing said pawl to move and engage with said ratchet wheel so that said comb can be adjusted to and held in any position.

2. A hair frame as recited in claim 1 wherein said frame further comprises:

(a) a front vertical ornamental member;

(b) a rear vertical member having a centrally located aperture and another aperture adjacent to one end thereof; and (c) a horizontal member affixed between top of said front vertical ornamental member and top of said rear vertical member so that said front vertical ornamental member will cover and hide said ratchet wheel and said pawl.

3. A hair frame which comprises:

(a) a comb having a centrally located aperture in back portion;

(b) a head band having an annular slot;

(c) a slide member having two apertures, said slide member slidably fits into said slot in said head band;

(d) a ratchet wheel having a forward and rearward shaft, said rearward shaft passes through one said aperture in said slide member and centrally located aperture in said back portion of said comb so that a head can be formed on free end of said rearward shaft by pressing, affixing said ratchet wheel to said comb allowing said comb and said ratchet wheel to rotate together;

(e) a spring loaded pawl having a forward shaft and a rearward shaft, said rearward shaft mates with said other aperture of said slide member, allowing said pawl to move and engage with said ratchet wheel so that said comb can slide to, be adjusted to and held in any position; and (f) an ornamental front plate having a pair of shaft supports on rear surface each said shaft support mounts onto free end of said forward shaft of said ratchet wheel and said forward shaft of said pawl allowing both said forward shafts to turn whereby said ornamental front plate is held in position so that said ornamental front plate will cover and hide said ratchet wheel and said pawl.

* * * * *